United States Patent [19]

Pino et al.

[11] Patent Number: 5,065,909

[45] Date of Patent: Nov. 19, 1991

[54] VENTED BEVERAGE CAN COVER HAVING PIVOTAL SPOUT

[75] Inventors: Giovanni Pino, Kentwood, Mich.; Thomas W. Scherer, Mansfield; Ruth A. Stephens, Norton, both of Ohio

[73] Assignee: Threeco, Barberton, Ohio

[21] Appl. No.: 443,488

[22] Filed: Nov. 29, 1989

[51] Int. Cl.[5] ..... B67D 3/00

[52] U.S. Cl. ..... 222/484; 222/536; 222/570

[58] Field of Search ..... 222/526, 528, 531, 538, 222/211, 482, 570, 464, 484, 534, 536, 556; 215/215, 236, 354, 1 A; 220/90.2, 90.4, 90.6, 335, 336

[56] References Cited

U.S. PATENT DOCUMENTS

| | | | |
|---|---|---|---|
| 2,936,934 | 5/1960 | Kubiliunas | 222/484 |
| 2,979,238 | 4/1961 | Bramming | 222/484 |
| 3,089,626 | 5/1963 | Kubiliunas | 222/484 |
| 3,251,516 | 5/1966 | Thomas | 222/536 |
| 3,283,967 | 11/1966 | Akers | 222/536 |
| 3,542,256 | 11/1970 | Waterman | 222/484 |
| 3,655,099 | 4/1972 | Hazard | 222/538 |
| 3,718,238 | 2/1973 | Hazard et al. | 222/538 |
| 3,840,153 | 10/1974 | Devlin | 222/536 X |
| 3,863,818 | 2/1975 | Hazard | 222/531 |
| 3,874,562 | 4/1975 | Hazard | 222/209 |
| 3,874,568 | 4/1975 | La Vange et al. | 222/531 X |
| 4,124,151 | 11/1978 | Hazard | 222/556 X |
| 4,219,138 | 8/1980 | Hazard | 222/534 |
| 4,485,963 | 12/1984 | Panicci | 222/536 X |
| 4,519,529 | 5/1985 | Seltz | 222/484 |
| 4,674,661 | 6/1987 | Herold | 222/528 |
| 4,732,303 | 3/1988 | Wang | 222/484 |
| 4,776,501 | 10/1988 | Ostrowsky | 222/534 X |
| 4,930,666 | 6/1990 | Rudick | 222/484 X |
| 4,962,869 | 10/1990 | Gross et al. | 222/556 X |

FOREIGN PATENT DOCUMENTS

| | | | |
|---|---|---|---|
| 1051748 | 12/1966 | United Kingdom | 222/531 |

*Primary Examiner*—Kevin P. Shaver
*Attorney, Agent, or Firm*—Waters & Morse

[57] ABSTRACT

This cover for an open standard beverage can, or a container of similar end configuration, includes a cap having an outlet passage and a vent, and a valve received in the cap with a snap-in assembly. The valve has a tubular lever that can be put in communication with the outlet passage to form a mouthpiece. Under this condition, the valve also opens the vent.

2 Claims, 2 Drawing Sheets

VENTED BEVERAGE CAN COVER HAVING PIVOTAL SPOUT

BACKGROUND OF THE INVENTION

Beverage cans are in such general use that their dimensions and opening features have become standardized. Some other containers have adopted the same end configuration. Once open, the containers are at the mercy of accidental spillage, and deterioration of the degree of carbonation. For women, tipping up an open can, and swilling out its contents, is a somewhat indelicate operation; and for children, it invites disaster to the clothing. Several attempts have been made to produce snap-on covers for a standard beverage can that would close off the can when the contents were not wanted at that moment, and provide the effect of a drinking straw when the contents were desired. Low cost and simplicity of construction are critical factors. The fact that these devices have not been in wide use is some evidence of their shortcomings.

SUMMARY OF THE INVENTION

The present invention provides a three-piece cover device in which the components require only a push-on or snap-in assembly. The components are a length of standard tubing extending from the cover into the container, a cap over the opened end, and a rotary valve with a tubular actuating lever that also functions as a mouthpiece. The cap has a recess receiving the valve body, which controls both an outlet passage and a vent to admit air as the contents are withdrawn. The cap recess and the valve have interengageable bearing receptacles and journal projections that can be forcibly engaged, accompanied by deflection of the cap material forming the recess.

DESCRIPTION OF THE PREFERRED EMBODIMENT

Figure 1:
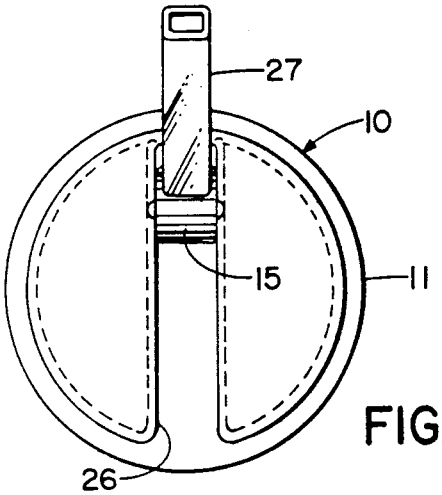
FIG. 1 is a top view of the cover assembly.
Figure 2:
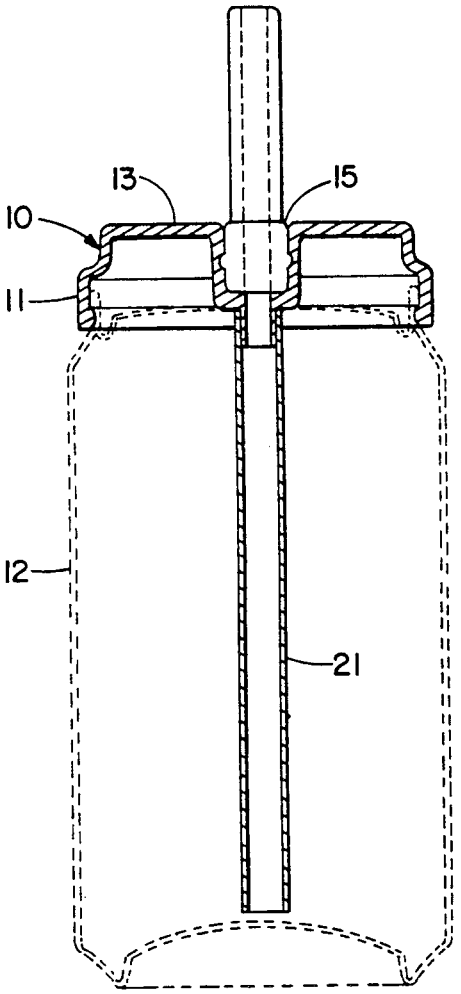
FIG. 2 is a central section through the assembly parallel to the rotational axis of the valve.
Figure 5:
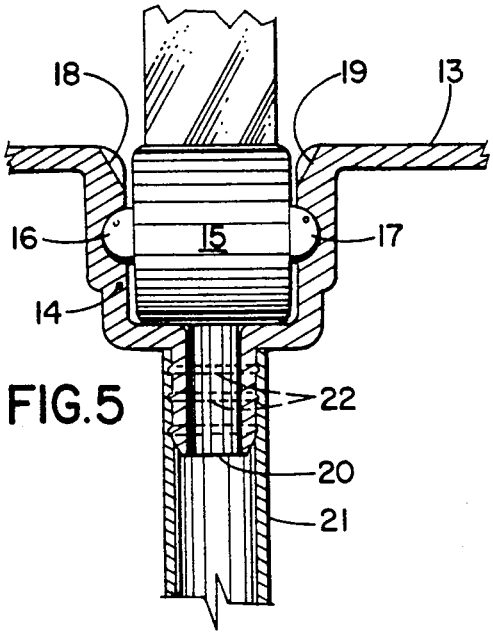
FIG. 5 is a central section through the cap.

Referring to FIGS. 1 and 2, the cover assembly is shown with the valve in the open position. In FIG. 2, a standard twelve ounce beverage can is shown in dotted lines. The cap 10 has a peripheral collar 11 dimensioned to snap over the end bead of the can 12. The cap is preferably of injection-molded polypropylene, with a wall thickness of approximately 0.050 inches. Referring to FIG. 5, the top 13 has a recess of cylindrical curvature 14, which receives the similarly shaped cylindrical valve body 15. The dome-shaped journal projections 16 and 17 on the valve body engage similarly-shaped receptacles in the walls of the cover defining the recess 14. The valve body is forced into the assembled position shown in FIG. 5, accompanied by the outward deflection of the walls containing the bearing receptacles. The dome-shaped curvature of the journals, together with the cam surfaces 18 and 19 at the entrance to the recess, cooperate in inducing this necessary deflection without injury to the components. Normally, this snap-in assembly will be made immediately after the parts are withdrawn from the molding die, and are still quite warm.

The portion of the cap forming the recess 14 also provides a nipple 20, which receives a length of standard plastic tube 21 extending down into the can to form (with the nipple 20) a withdrawal passage through which the contents of the can can pass during the open condition of the valve. Preferably, the nipple 20 is provided with circumferential ridges as shown at 22 to assist in retaining the tube 21. The resilience of the material of which the cap is formed permits it to be pulled out of the molding die, in spite of the apparent degree of interlock at the ridges 22, and at the die components forming the bearing receptacles.

Figure 3:
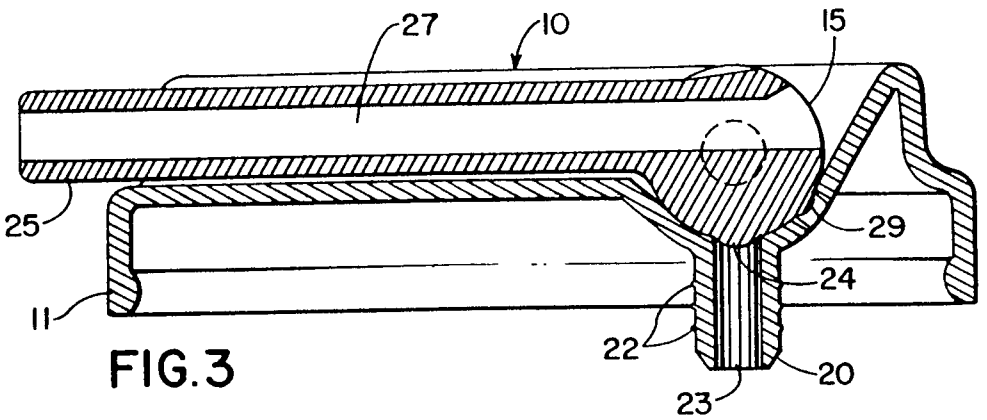
FIG. 3 is a central section on an enlarged scale on a plane perpendicular to the rotary axis of the valve, showing the closed position.
Figure 4:
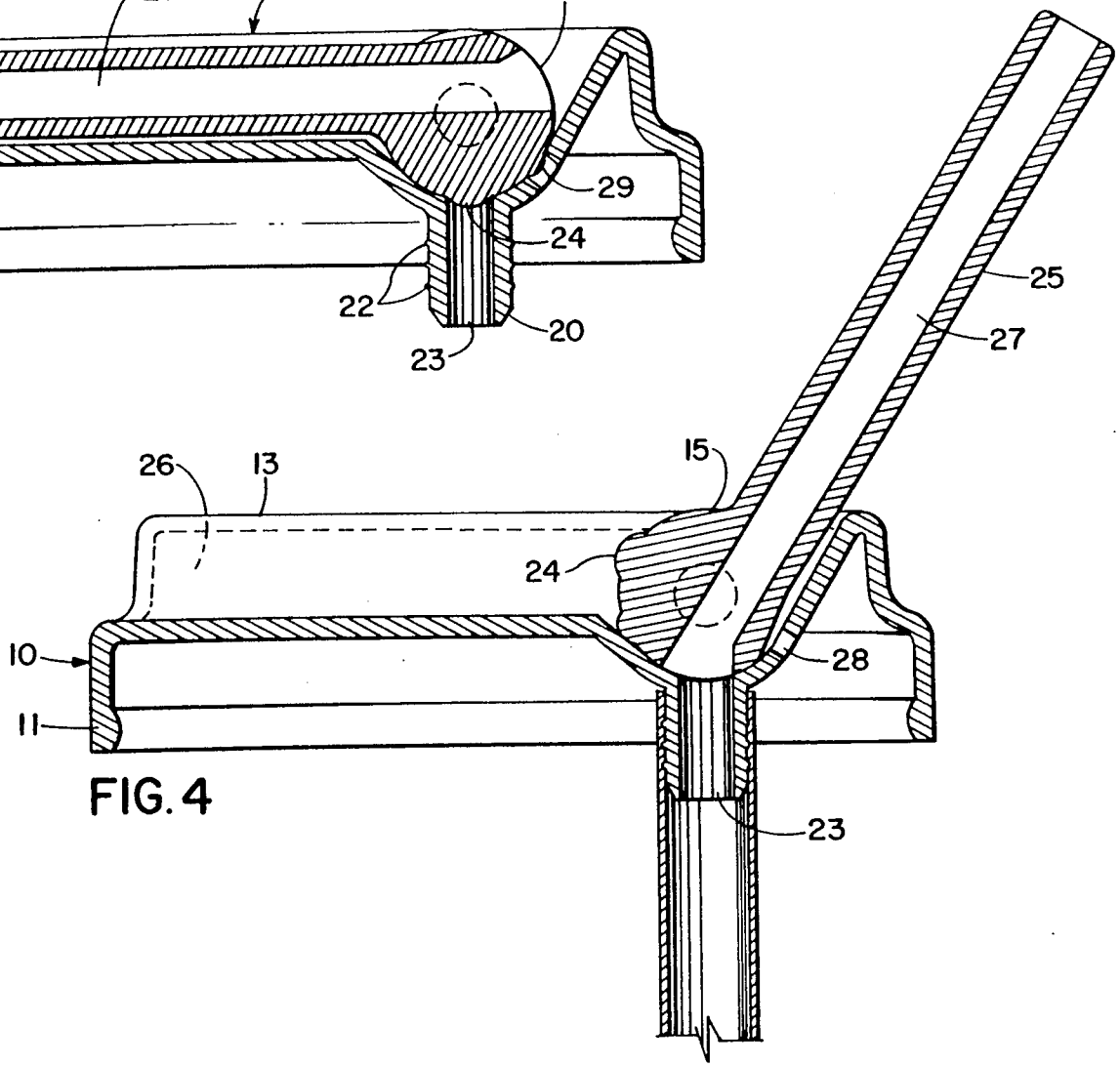
FIG. 4 is a view similar to FIG. 3, but with the valve in the open position.

Referring to FIGS. 3 and 4, the passage section 23 formed by the nipple 20 is shown in FIG. 3 closed by the valve 15. This valve has a dome-shaped protrusion 24 which snaps into the upper opening of the passage 23 to seal off the opening, and also provide a snap retention of the valve in the closed position. The valve also has a tubular lever 25 that forms a mouthpiece for withdrawing the contents of the can, and a handle for positioning the valve. In the closed position shown in FIG. 3, the lever 25 is received within a recess 26 extending from the recess 14. In the open position shown in FIG. 4, the interior passage 27 of the tubular lever 25 is placed in communication with the passage 23 of the nipple 20. This position also opens the vent 28 in the wall of the cap forming the recess 14, permitting air to enter into the can through the vent passage provided by the space between the recess wall and the valve member in the FIG. 4 position, as the contents are withdrawn. The valve 15 has a second dome 29, which snaps into the vent opening in the closed position shown in FIG. 3. The valve unit is protected in the FIG. 3 position by its reception into the recess 26, and extends slightly beyond the edge of the cap to facilitate gripping the lever to swing the valve to the open position. This one-piece valve unit is preferably injection-molded from styrene. The specific dimensions of the valve and the recess receiving it are selected to provide sufficient pressure between the valve and the inside surface of the recess 14 to maintain a good seal. Rotation of the valve that brings the domes 24 and 29 out of engagement with the withdrawal passage 23 and the vent opening 29 must be accompanied by deflection of the wall of the cap forming the recess 14. The selected dimensions will vary somewhat with the selection of materials and the wall thickness used.

I claim:

1. A cover assembly for a beverage container, said cover assembly including a cap engageable with a standard container, said cap providing an outlet passage traversing said cap, said cover assembly also including a valve member having a tubular lever portion and rotatably mounted on said cap for movement between a position closing said passage and a position opening said passage to communication with said tubular lever portion, wherein the improvement comprises:

means forming a vent opening in said cap, said valve being adapted to open said vent opening with said valve in position to open said passage. and close said vent opening with said valve in position to close said passage, said valve having protrusions engaging said passage and vent opening in said closed position, said cap having a wall forming a recess of cylindrical curvature having an axis, and said vent opening and outlet passage traversing said cap at said recess, said valve having a configuration providing a vent passage exclusively within said recess communicating with said vent opening in said open position.

2. A cover assembly as defined in claim 1, wherein said cap additionally has a depression adapted to receive said tubular lever portion in the closed position of said valve.

* * * * *